US005203128A

United States Patent [19]

Bennett

[11] Patent Number: 5,203,128

[45] **Date of Patent: * Apr. 20, 1993**

[54] PRECAST STAIR SYSTEM HAVING IMPROVED RELEASABLY CONNECTED STEPS

[76] Inventor: Eldon R. Bennett, 550 Canal Rd., Apt. B, Sarasota, Fla. 34242

[ * ] Notice: The portion of the term of this patent subsequent to Feb. 26, 2008 has been disclaimed.

[21] Appl. No.: 695,728

[22] Filed: May 6, 1991

[51] Int. Cl.[5] ..... E04F 19/10

[52] U.S. Cl. ..... 52/189; 52/190; 411/82

[58] Field of Search ..... 52/125.5, 182, 183, 52/188, 189, 190, 191; 411/82, 258, 103

[56] References Cited

U.S. PATENT DOCUMENTS

| | | | |
|---|---|---|---|
| 2,555,002 | 5/1951 | Phillips et al. | 52/188 |
| 2,940,784 | 6/1960 | Fell | 52/126.5 X |
| 3,307,308 | 3/1967 | Lyons | 52/190 |
| 3,875,708 | 4/1975 | Thornes | 52/189 |
| 4,679,362 | 7/1987 | Mess | 52/125.5 |
| 4,840,524 | 6/1989 | Bisping et al. | 411/82 |
| 4,915,557 | 4/1990 | Stafford | 411/82 X |
| 4,995,205 | 2/1991 | Bennett | 52/189 |

FOREIGN PATENT DOCUMENTS

| | | | |
|---|---|---|---|
| 1531944 | 5/1968 | France | 52/125.5 |

*Primary Examiner*—David A. Scherbel
*Assistant Examiner*—Kien Nguyen
*Attorney, Agent, or Firm*—William E. Noonan

[57] ABSTRACT

A precast stair system having releasably mounted steps is disclosed. The system includes first and second elongate, generally parallel stringer elements having respective inner surfaces that face each other and a plurality of individually precast steps that are precast independently of the stringer elements. Each step extends side to side from a first end that engages the inner surface of the first stringer element to an opposite second end that engages the inner surface of the second stringer element. The steps are juxtaposed in an ascending pattern along the stringer elements. Each step is releasably fastened to each stringer element. In particular, a first connector is formed through the inner surface of the first stringer element and through the first end of the step and a second connector is formed through the inner surface of the second stringer element and through the second end of the step.

13 Claims, 3 Drawing Sheets

PRECAST STAIR SYSTEM HAVING IMPROVED RELEASABLY CONNECTED STEPS

FIELD OF THE INVENTION

This invention relates to a stair system and, more particularly, to a stairway constructed of precast concrete and having releasably mounted steps.

BACKGROUND OF THE INVENTION

Conventional precast concrete stairways exhibit a number of disadvantages. Very often, such stairs are constructed in a form or mold that has a step-shaped bottom surface for defining the steps and an open upper end into which the concrete is poured. This form creates a stairway that exhibits a heavy flat slab along its bottom surface. Such a stairway requires unnecessarily large amounts of concrete and is quite heavy. Moreover, because the bottom of the mold forms the steps, it is impossible to add a hardening or wear resistant material to the steps as they are forming in their wet condition. Such stair systems are also quite inflexible. The dimensions of each step form typically cannot be adjusted to match desired floor and building heights. A completely new form is required for each variation in height.

A stair system utilizing individually precast steps is known. In that system, steps are formed and then permanently cast into a pair of supporting side walls. Accordingly, worn or defective steps cannot be conveniently removed and replaced. Moreover, these steps are formed in an enclosed mold, which, again does not permit the addition of hardening or wear resistent materials to the concrete being cast. Additionally, this system does not permit the adjustment of tread depth and lateral width as well as riser height and width.

Certain of the above difficulties are successfully addressed by the precast stair system disclosed in my U.S. Pat. No. 4,995,205. Although that system exhibits significant improvements over the prior art, it typically employs a stringer structure that features step-shaped recesses for accommodating the steps. Such stringers must be carefully cast to closely conform to the shape of the steps. Imprecise casting can result in a defective structure. A simpler stringer structure and a quicker, more effective technique for releasably securing the steps to the stringer means are desired.

SUMMARY OF INVENTION

Therefore, an object of this invention is to provide an improved precast stair system employing individually precast steps that are readily removable from, and replaceable upon an independent stringer structure.

It is a further object of this invention to provide an improved releasable step connector apparatus for a precast stair system that permits individual steps to be installed, removed and replaced quickly, inexpensively and effectively.

It is a further object of this invention to provide a precast stair system that utilizes a simpler, less expensive stringer structure that does not require precise fitting to the steps.

It is a further object of this invention to provide a precast stair system that employs less concrete material than is required in conventional systems.

It is a further object of this invention to provide a precast stair system that permits special hardening and wear resistent materials to be conveniently added during the formation process to improve stair wear and increase stair life.

It is a further object of this invention to provide a precast stair system that exhibits an improved fire rating.

This invention relates to a precast stair system having releasably mounted steps. The stair system includes first and second elongate, generally parallel stringer elements that have respective inner surfaces facing each other. There are a plurality of individually precast steps that are precast independently of the stringer elements. Each step extends side to side from a first end that engages the inner surface of the first stringer element to an opposite second end that engages the inner surface of the second stringer element. The steps are juxtaposed in an ascending pattern along the stringer elements. Means are provided for releasably fastening each step to each stringer element. Such means for releasably fastening include first releasable connector means that are formed through the inner surface of the first stringer element and through the first end of the step and second releasable connector means that are formed through the inner surface of the second stringer element and through the second end of the steps.

In a preferred embodiment, the releasable connector means include a threaded receptacle that is cast in the step and is alignable with a complementary opening in the stringer element, and a threaded element that is received by the opening and engaged with the receptacle to releasably fasten the step and the stringer element. The connector may further include a sleeve that is cast in the stringer element about the opening for receiving the threaded element therethrough. The insertion member may include a bolt having a threaded shaft portion and a head portion. The sleeve may include a smaller diameter segment for accommodating the shaft portion of the bolt and a larger diameter segment that is aligned with the smaller diameter segment for receiving the head portion of the bolt. The releasable connector means may include a pair of threaded receptacles that are cast in the step and are alignable with respective complementary openings in the stringer. A pair of threaded elements may be respectively received by the openings and engaged with the receptacles to releasably fasten the step and stringer element. These receptacles and openings may be arranged in a generally vertical alignment.

The step may include a thread portion and a riser portion that is integrally connected to the tread portion and extends generally downwardly therefrom. Means may be provided for releasably interconnecting adjacent pairs of the steps. Such means for releasably interconnecting may include a threaded receptacle that is cast in the riser of the upper one of the steps and is alignable with a complementary opening in the tread of the lower one of the steps. A threaded element may be received by the opening and engaged with the receptacle to releasably interconnect the lower and upper steps. The means for releasably interconnecting may further include a sleeve that is cast in the tread of the lower step about the opening for receiving the threaded element therethrough. The insertion member and sleeve for interconnecting adjacent steps ma be similar in construction to the insertion member and sleeve that are used to releasably interconnect the steps with the stringers.

DETAILED DESCRIPTION OF PREFERRED EMBODIMENT

Other objects, features and advantages will occur from the following description of a preferred embodiment and the accompanying drawings in which.

Figure 1:
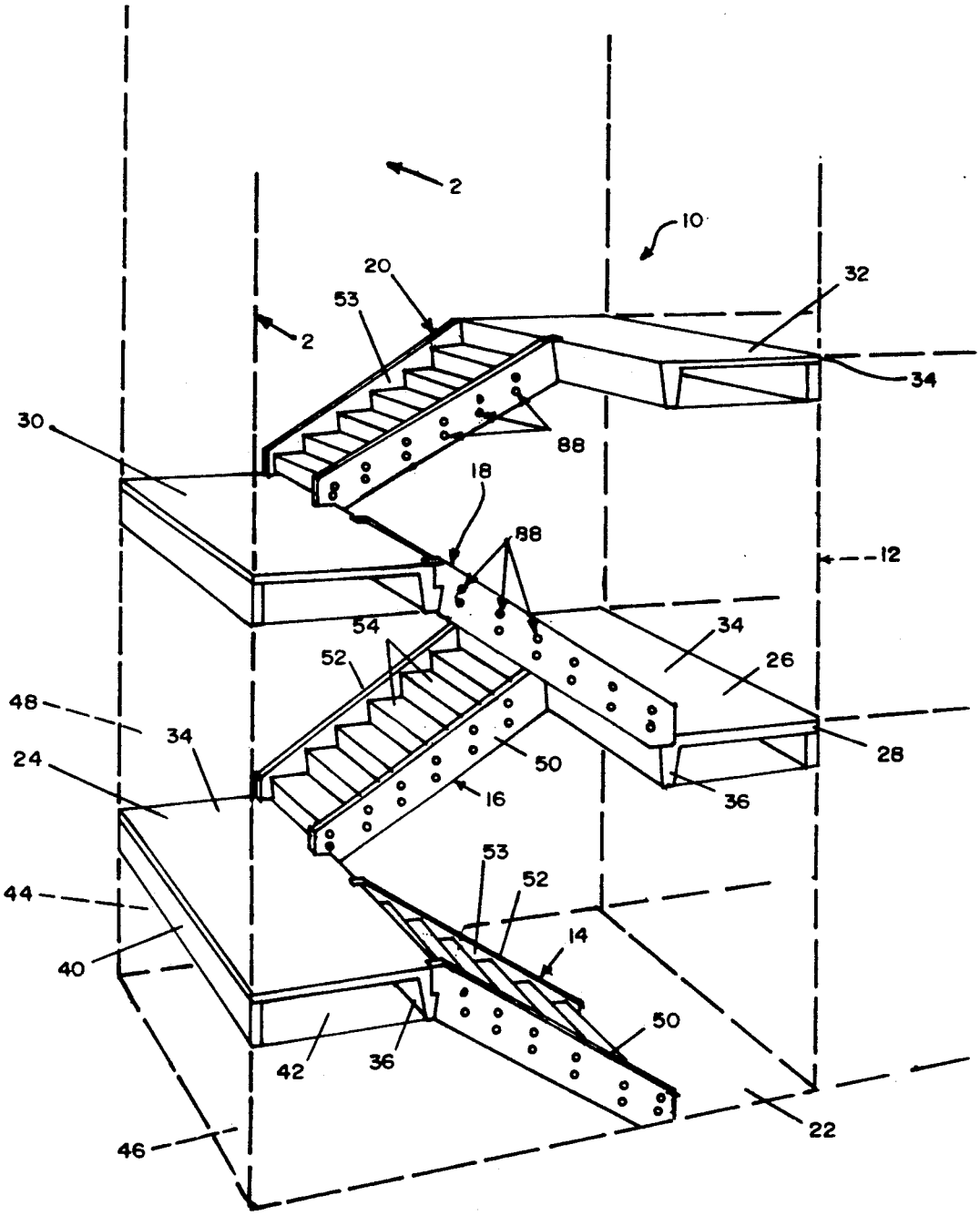
FIG. 1 is a perspective view of a stair system that employs releasably mounted steps in accordance with this invention.

There is shown in FIG. 1 a multiple level stairway 10 that is built within a stairwell 12, shown in phantom. For purposes of illustration, stairway 10 is depicted in an interior stairwell. However, it should be understood that alternative structures employing the principles of this invention may be constructed outside of a building. Stairway 10 includes four landings 24, 26, 30 and 32 that are mounted in stairwell 12 as described below. Landings 26 and 32 are formed at the first and second floors or levels 28 and 34, respectively. Landing 34 is mounted between the ground level 22 and first level 28. Landing 30 is similarly mounted intermediate the first and second levels.

Stairway 10 also includes four flights of stairs 14, 16, 18 and 20 that ascend the stairwell 12 and are supported by the landings. Typically, two flights are used between each level or floor of the building. In particular, first flight 14 ascends from ground level 22 to intermediate landing 24. Second flight 16 ascends from landing 24 to landing 26. From landing 26, flight 18 rises to intermediate landing 30. Finally, flight 20 ascends from landing 30 to landing 32 at second floor or level 34. In alternative embodiments, a single flight or another number of multiple flights may be employed.

Each of the landings 24, 26, 30 and 32 includes a generally planar, horizontal slab portion 34 and a joist portion 36 that depends generally from the forward edge of slab portion 34. Each landing is supported within stairwell 12 by a plurality of soffit beams that are mounted to the exterior walls of enclosure 12. For example, soffit beams 40 and 42 are anchored to stairwell walls 44 and 46, respectively by bolts, or other suitable means. A similar soffit beam, whose view is obscured, is likewise secured to stairwell wall 48. Landing 24 is mounted on these soffit beams and is secured thereto by bolts weld plates or similar means. The remaining landings 26, 30 and 32 are supported in a similar manner.

Each of the flights of stairs 14, 16, 18 and 20 includes a pair of elongate, generally parallel stringer elements 50 and 52, having respective inside surfaces 53 (FIG. 1) and 55 (FIG. 3) that face each other. The stringers support a plurality of individually precast steps 54 that are juxtaposed along the stringers. Each step 54 extends side to side between inside surface 53 of stringer 52 to inside surface 55 of stringer 50.

Figure 2:
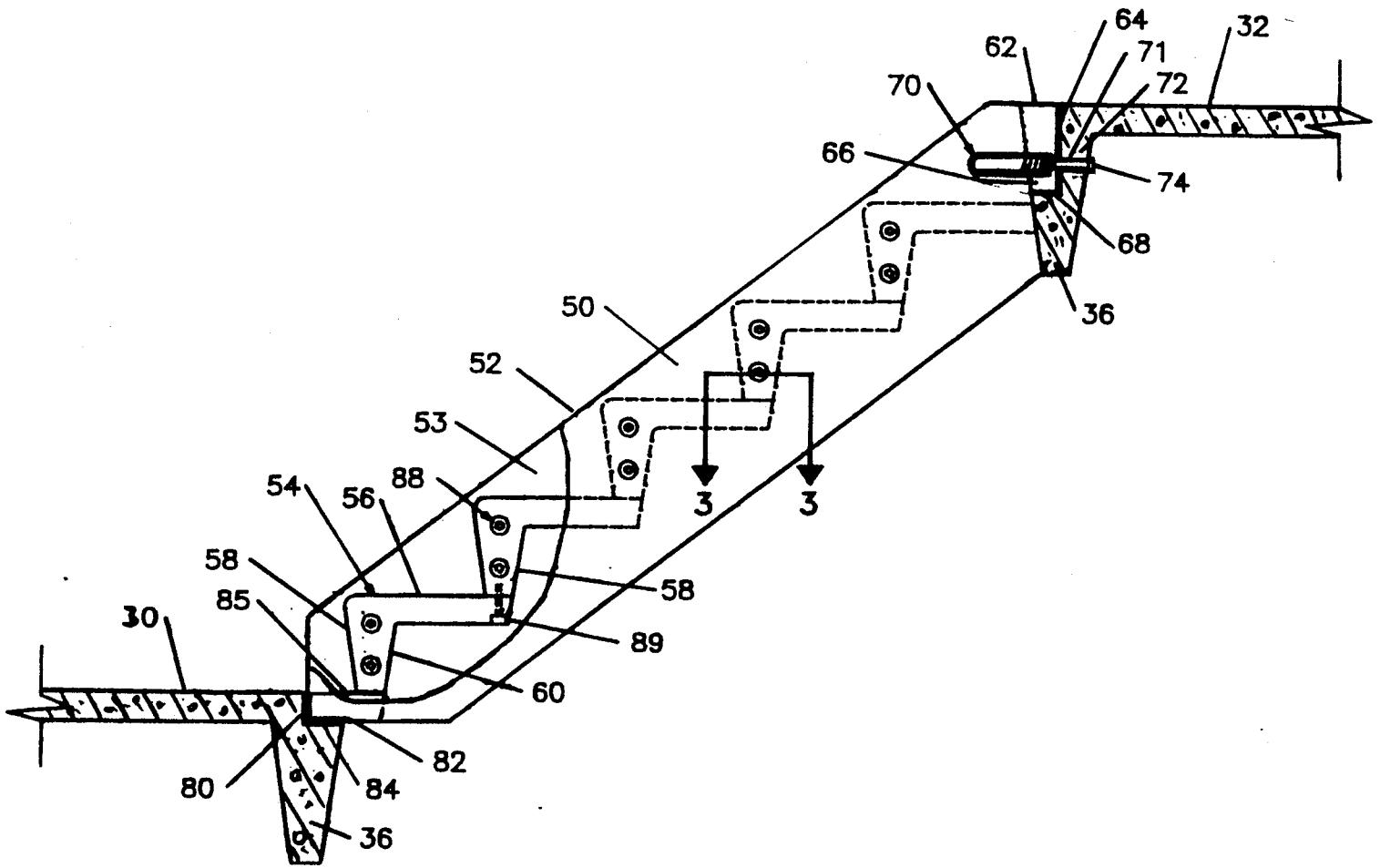
FIG. 2 is a cross-sectional view of one section of the stair system taken along line 2—2 of FIG. 1.

A representative flight of stairs 20 exhibiting the principles of this invention is depicted in FIG. 2. Therein, the stringers 50 and 52 of flight 20 are shown extending between lower landing 30 and upper landing 32. A similar construction may be utilized for any of the other flights of stairs. Each of the stringer elements may be precast in a manner such as in generally described in U.S. Pat. No. 4,995,205. However, unlike the device of that patent, step-shaped recesses are typically not required. Rather, each stringer element 50, 52 includes an upper extension section 62 that fits in a recess 64 formed in the joint 36 that depends from the forward end of the upper landing slab 32. Section 62 carries an angular bearing plate 66 that conformably engages an angular bearing plate seat 68 formed in recess 64. Plates 66 and 68 may be joined in a conventional manner by welding but this is not necessary. A threaded receptacle 70 is formed in the upper end of each stringer element through extension piece 62. Such a receptacle is typically cast into the stringer during the construction process. Receptacle 70 includes an opening that is aligned with a complementary opening 71 formed through landing joist 36. A tubular metal sleeve 72 is cast in the joist such that it surrounds opening 71. An anchoring bolt 74 extends through sleeve 72 and threadably engages receptacle 70 so that the upper end of the stringer element is releasably fastened to landing 32.

The lower end of each stringer element 50, 52 is received by a respective complementary shaped recess 80 formed in the joist 36 of the lower landing 30. Again, an angular bearing plate 82 may be carried by the lower end of the stringer element and a complementary angular bearing plate 84 may be formed in recess 80. Attachment may be completed by welding plate 82 to plate 84. As previously indicated in U.S. Pat. No. 4,995,205, such weld plate attachments may be broken when required by suitable means such as an acetylene torch. Each landing slab 34 includes an extension piece 85 that extends between stringers 50 and 52 and engages the lowermost step 54 in the flight. For the first flight of stairs 14, FIG. 1, the lower ends of the stringer elements 50 and 52 engage the floor or ground level 22. The lower ends of the stringers may be secured to ground level 22 by various suitable means. Otherwise, the construction is analogous to that shown in FIG. 2.

Various alternative construction may be employed within the scope of the invention for supporting the upper and lower ends of the stringers. For example, the stringers may be attached to the soffit beams. Additionally, the stringers may be constructed of various alternative non-precast materials such as steel or wood.

As best shown in FIG. 2, each precast step 54 includes a generally horizontal tread portion 56 and a generally vertical riser portion 58 that is integrally connected to and depends from tread portion 56. Each riser 58 engages the tread of the next lower step, except for the lowermost riser, which engages landing step extension piece 85. Each step 54 is precast, for example as disclosed in U.S. Pat. No. 4,995,205, the specification of which is incorporated herein by reference. More particularly, the steps may be composed of concrete or other materials such as plastic or fiberglass. A conventional reinforcing material such as welded wire, fabric or rebar may be utilized. The tread surface of each step 54 may also be provided with a wear and slip resistent substance such as aluminum oxide, granite, emery or various other metallic or stone finishes. Surface 60 of riser 58 is provided with a slight slope of, for example, approximately ⅛" for each inch of height. This slope or draft enhances the fire rating of the step by permitting additional material to be employed. Moreover, it makes the step easier to remove from the mold. Additionally, the lateral width of the tread and riser, as well as the height of the tread and the depth of the riser may be adjusted as required.

Figure 3:
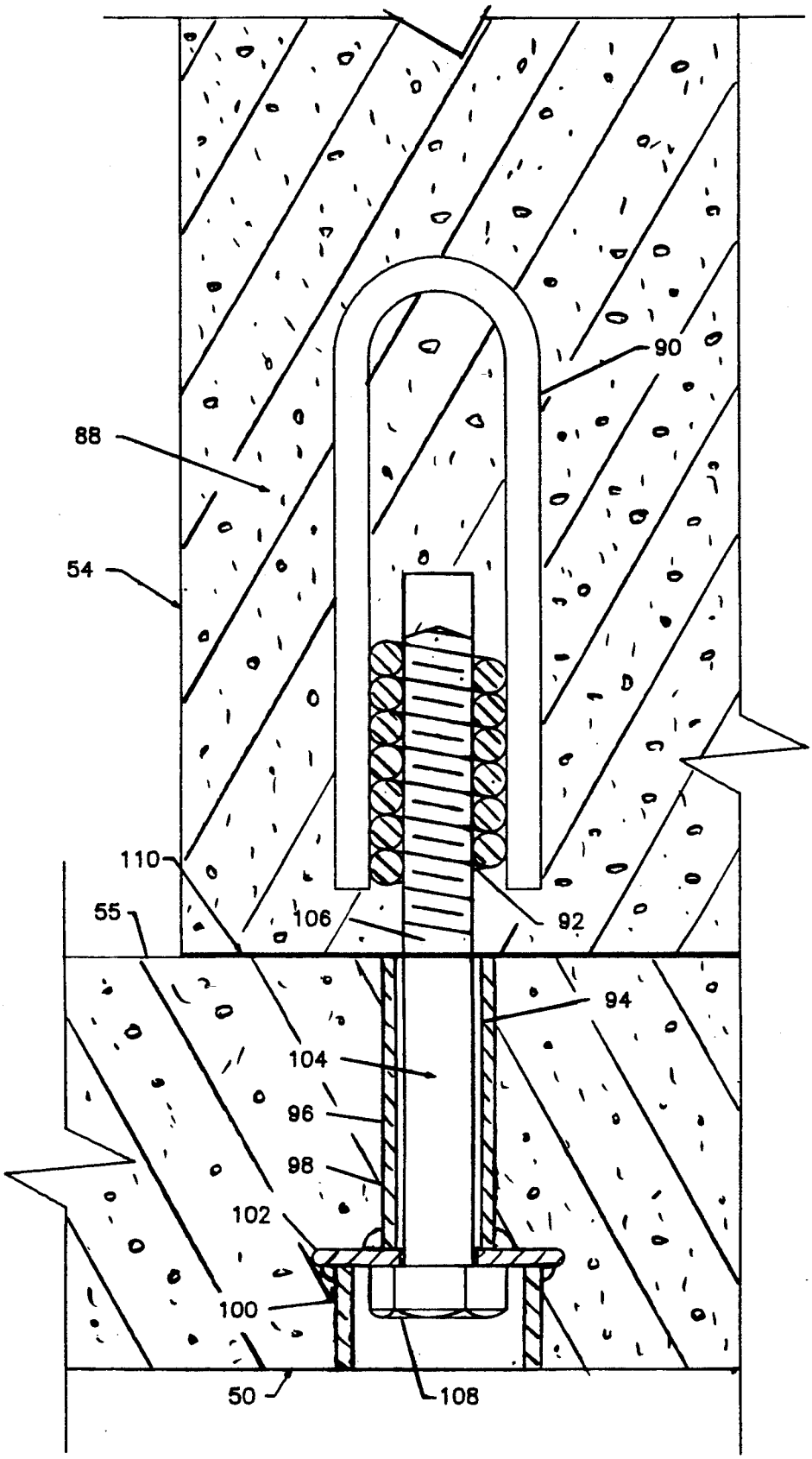
FIG. 3 is a cross-sectional view of a preferred releasable connector means, taken along line 3—3 of FIG. 2.

Each step 54 is releasably fastened at one end thereof to stringer element 50 by a pair of connector devices 88. The opposite end of each step 54 is similarly attached by a pair of such connectors to stringer 52. A representative releasable connector device 88 for making each of these attachments is illustrated in FIG. 3. As shown therein, the connector includes a threaded receptacle 90 that is cast into the step. Receptacle 90 has an opening 92 that is aligned with an opening 94 that is formed transversely through inside surface 55 of stinger 50. A sleeve 96 is cast in stringer 50 about opening 94. In embodiments not employing precast stringers a sleeve may not be required. Sleeve 96 includes a smaller diameter segment 98 and a larger diameter segment 100. Segments 98 and 100 are formed by respective thin walled tubes that are separated by a washer 102. Sleeve 96 accommodates a bolt 104, which may include a ½" coil bolt or similar element. Bolt 104 has a threaded shaft portion 106 that extends through sleeve segment 98, through inside surface 55 of stringer 50, through the end of the step, and into threaded receptacle 90. The bolt also includes a head portion 108 that fits within sleeve segment 100. Head portion 108 is engaged by a suitable wrench to tighten the bolt into receptacle 90. After each of the four connector devices 88 is fastened, epoxy grout 110 may be introduced between the step 54 and each stringer.

As shown in FIGS. 1 and 2, each pair of connector devices 88 are arranged along a generally vertical line in the riser section 58. By employing connector devices 88 in such an arrangement, the steps 54 are prevented from rotating or wobbling relative to the stringer elements. As a result, the steps are securely, yet releasably attached between the stringer elements.

In alternative embodiments only a single connector 88 is used at each end of the step. In such cases, wobbling and rotation of the steps is prevented by use of a releasable connector device 89, FIG. 2, that is formed through the forward end of the tread section 56 and the lower end of the next higher step is riser section 58. Connector device 89 is analogous in construction to connector device 88 and permits secure, yet releasable interconnection to be made between each pair of adjacent steps 54.

To construct the stairway 10, the landings are first mounted within the stairwell or to an alternative interior or exterior structure. Then, stringers having a desired length are mounted in the manner shown between the ground floor and the first landing or between landings. Finally, the stairs, which are cast in a desired size, are releasably secured between the stringer elements by connector devices 88. To remove or replace a step, the four bolts 108 that secure each step are simply loosened and the step is removed.

Although the releasable connector apparatus is shown in use with a stair system that includes a number of landings, such a connector apparatus may also be employed in various other types of interior and exterior precast stair systems. For example, such means may be employed to releasably fasten precast steps to a stringer that include extension portions for supporting a landing in the manner shown in U.S. Pat. No. 4,995,205. It may also be used in various other precast stair systems that do not employ landings at all, but rather wherein the stringers are secured directly to the building.

The unique manner of releasable attachment permits the precast steps to be quickly and conveniently attached to and removed from the stringers. Moreover, it permits the use of a greatly simplified and economical stringer structure, which does not require the formation of a step-shaped recess.

Although specific features of the invention are shown in some of the drawings and not others, this is for convenience only as each feature may be combined with any an all other features in accordance with this invention.

Other embodiments will occur to those skilled in the art and are within the following claims.

What is claimed is:

1. A precast stair system having releasably mounted steps comprising:

first and second elongate, generally parallel stringer elements having respective inner surfaces that face each other;

a plurality of individually precast steps, each step extending side to side from a first end that engages the inner surface of said first stringer element to an opposite second end that engages the inner surface of said second stringer element, said steps being juxtaposed in an ascending pattern along said stringer elements; and means for releasably fastening each said step to each said stringer element including first releasable connector means formed through said inner surface of said first stinger element and through said first end of said step and second releasable connector means formed through said inner surface of said second stringer element and through said second end of said step.

2. The stair system of claim 1 in which each said releasable connector means include a threaded receptacle that is cast in said step and is alignable with a complementary opening in a respective said stringer element and a threaded element that is receivable by said opening and engageable with said receptacle to releasably fasten said step and said stringer element.

3. The stair system of claim 2 in which said connector means further includes a sleeve that is cast in said respective stringer element about said opening for receiving said threaded element therethrough.

4. The stair system of claim 3 in which said threaded element includes a bolt having a threaded shaft portion and a head portion.

5. The stair system of claim 4 in which said sleeve includes a smaller diameter segment for accommodating said shaft portion of said bolt and a larger diameter segment that is aligned with said smaller diameter segment for receiving said head portion of said bolt.

6. The stair system of claim 1 in which each said releasable connector means includes a pair of threaded receptacles that are cast in said step and are axially alignable with respective complementary openings in a respective said stringer element, and a pair of threaded elements that are respectively receivable by said openings and engageable with said receptacles to releasably fasten said step and said stringer element.

7. The stair system of claim 1 in which each step includes a tread portion and a riser portion that is integrally connected to said tread portion and extends generally downwardly therefrom.

8. The stair system of claim 7 further including means for releasably interconnecting adjacent pairs of steps.

9. The system of claim 8 in which said means for releasably interconnecting include a threaded receptacle that is cast in said riser of an upper one of said steps and is alignable with a complementary opening in said tread of a lower one of said steps, and a threaded element receivable by said opening and engageable with said receptacle to releasably interconnect said upper and lower steps.

10. The system of claim 9 in which said means for releasably interconnecting further includes a sleeve cast in said tread of the lower step about said opening for receiving said threaded element therethrough.

11. The stair system of claim 10 in which said insertion member includes a bolt having a threaded shaft portion and a head portion.

12. The stair system of claim 11 in which said sleeve includes a smaller diameter segment for accommodating said shaft portion of said bolt and a larger diameter segment that is aligned with said smaller diameter segment for receiving said head portion of said bolt.

13. The stair system of claim 1 further including a landing disposed proximate an upper end of said stringer elements, said landing including a generally horizontal portion that defines a landiong surface and a generally vertical portion that depends from said horizontal portion.

* * * * *